United States Patent [19]

Graybill

[11] 4,147,116

[45] Apr. 3, 1979

[54] PULVERIZED COAL BURNER FOR FURNACE AND OPERATING METHOD

[75] Inventor: Robert W. Graybill, York, Pa.

[73] Assignee: Farrier Industries, Inc., York, Pa.

[21] Appl. No.: 834,236

[22] Filed: Sep. 19, 1977

[51] Int. Cl.[2] ..... F23K 5/00

[52] U.S. Cl. ..... 110/263; 110/264; 431/185; 110/347

[58] Field of Search ..... 110/347, 348, 260–265, 110/306, 232; 431/182–186; 239/399–402, 403–406

[56] References Cited

U.S. PATENT DOCUMENTS

| | | | |
|---|---|---|---|
| 585,572 | 6/1897 | Heavy | 110/263 |
| 744,220 | 11/1903 | Neu | 110/260 |
| 1,726,870 | 9/1929 | Trent | 110/261 |
| 1,841,831 | 1/1932 | Marston | 431/185 |
| 1,843,662 | 2/1932 | Craig et al. | 431/184 |
| 2,716,002 | 8/1955 | Gnaig | 110/106 |
| 2,849,968 | 9/1958 | Krug | 110/106 |
| 3,002,472 | 10/1961 | Miller | 110/106 |
| 3,299,841 | 1/1967 | Hemker et al. | 110/262 |
| 4,041,906 | 8/1977 | Edwards | 110/106 |

FOREIGN PATENT DOCUMENTS

| | | | |
|---|---|---|---|
| 1117993 | 5/1956 | France | 110/264 |
| 30593 | 8/1933 | Netherlands | 110/264 |

*Primary Examiner*—Henry C. Yuen
*Attorney, Agent, or Firm*—C. Hercus Just

[57] ABSTRACT

A pulverized coal burner for a furnace adapted to be used in conjunction with a pulverizer which reduces coal to approximately 40 microns size in the presence of inert steam which conveys it under pressure to said burner tangentially to spiral the same within a fuel tube around a coaxial central tube axially adjustable within the fuel tube to adjust the relation between flared distribution and mixing members respectively on the discharge ends of said tubes. Combustion air is fed coaxially around the discharge end of the fuel tube for thorough mixture with the coal which is conveyed with a minimum amount of steam through said tube so as not to deter combustion in the combustion zone which is immediately adjacent the discharge end of the fuel and central tubes.

7 Claims, 5 Drawing Figures

PULVERIZED COAL BURNER FOR FURNACE AND OPERATING METHOD

BACKGROUND OF THE INVENTION

The present invention pertains to a coal burner for a furnace in which pulverized coal of very fine sizes is utilized. Preferably, the maximum coal size is 40 microns, this size being somewhat similar to talcum powder. When coal exists in this size, especially if stored, there is a great tendency for the same to be self-igniting and therefore, it is common practice at present to connect a pulverizing unit directly with the burner, whereby the coal in pulverized form of the maximum size referred to above, is delivered to the burner and also actually is pulverized in an inert atmosphere, such as dry steam. Such steam is also the means by which the pulverized coal is blown under pressure into the furnace and at the inner end of the burner is ignited, due to being contacted with combustion air. Common types of pulverized coal burners presently in existence utilize air to transmit the coal to the burner and the burner carries the necessary air well mixed with the coal to the burner nozzle for ignition.

The feeding of fuel in dust or powdered condition to a combustion chamber by means of steam basically is old. U.S. Pat. No. 585,572, in the name of B. C. Heavey, dated June 29, 1897, discloses a furnace and burner in which this is accomplished.

U.S. Pat. No. 744,220, in the name of A. Neu, dated Nov. 17, 1903, discloses a fuel burner in which oil or ground coal is mixed with steam and air by a suitable apparatus for delivery to a furnace but the steam and fuel are not mixed until they reach the point of discharge into the furnace which is accomplished by means of a conical valve that spirals the fuel incident to being discharged.

U.S. Pat. No. 1,370,091, in the name of W. W. Conard, dated Mar. 1, 1921, discloses what appears to be a wheeled vehicle that utilizes pulverized fuel which is spiraled incident to feeding the same to a combustion chamber by means of nozzles.

More recently, U.S. Pat. No. 3,299,841, in the name of F. L. Hemker et al, dated Jan. 24, 1967, discloses a burner for a furnace in which powdered coal mixed with air is blown through a burner nozzle and at the delivery end of said nozzle, the mixture is expanded by a series of frusto-conical impellers on the delivery end of a concentric impeller tube that is mounted within the burner tube. Secondary air is mixed with the coal and primary air by means of a circular pattern of registers surrounding the burner nozzle, but there is no disclosure of the powdered coal being conveyed to the combustion zone by an inert gaseous vehicle.

When coal is transmitted to the combustion zone of a furnace by means of an inert gas, such as steam, the air required for ignition must be added to the mixture of coal and inert vehicle at the discharge end of the burner which is immediately adjacent the combustion zone in the furnace. In accordance with present invention, testing has proved that the ratio of coal to inert atmosphere or vehicle under such circumstances is critical to ignition, especially when steam is used to transmit coal in the very fine size range of 40 microns and finer. More specifically, it has been proven that the maximum ratio of approximately 2.5 pounds of steam to 1 pound of coal is required for clean burning of the fuel. It also has been found that the coal will burn even more effectively when the steam is reduced in this ratio where the coal is increased. The present invention is designed to either increase the coal or reduce the inert gas in the area of the burner where ignition is initiated. Details of such design are set forth below.

SUMMARY OF THE INVENTION

In order to solve the problem of effecting efficient ignition of finely divided coal carried within an inert vehicle, it is one of the principal objects of the present invention to provide means and a method of insuring said effective ignition by separating at least a substantial portion of the coal from the inert atmosphere as it passes in spiral fashion through a fuel tube, the coal being adjacent the inner surface of the tube in a certain degree of concentration, while the inert vehicle is more concentrated adjacent the central portion of the fuel tube, whereby there is a total absence of air within the fuel tube but combustion air is fed along the exterior of the fuel tube so that at the discharge end thereof, the coal and air effectively mix for immediate combustion as the same is directed into the combustion chamber of the furnace and the discharge of the separated portions of the inert vehicle atmosphere is of substantially no deterring effect upon such ignition, the sole purpose of the provision of the inert vehicle or atmosphere being to cause spiraling of the coal while moving through the fuel tube, and thereby effect separating of a substantial part of the coal from the inert vehicle by means of centrifugal force as the coal and at least partially separated inert vehicle move longitudinally along the fuel tube to the discharge end thereof.

It is a further object of the invention ancillary to the foregoing object to concentrate the coal in the area where ignition occurs and thereby, reduce the affect of higher inert atmospheres to coal ratios.

It is a further object of the invention to facilitate the mixing of combustion air with the pulverized coal at the discharge end of the fuel tube by means of an outwardly flared diffuser comprising a series of similar vanes respectively disposed at an acute angle to a plane transverse to the axis of the fuel tube and, as a still further object ancillary to the foregoing object, a central tube of substantially smaller diameter than the fuel tube, is supported coaxially within the fuel tube and a flared circular deflector in the form of a frustum of a cone is mounted on the outer end of said central tube and cooperates with the outwardly flared diffuser on the discharge end of the fuel tube to direct the coal in a somewhat conical expanded diffusion incident to being mixed with the combustion air in a highly effective and efficient manner.

Still another object of the invention is to provide means by which the central tube is axially adjustable within the fuel tube to vary the deflection of the coal particles, and thereby vary the shape and travel of the flame.

One further object of the invention is to provide means to mount said annular combustion air inlet port within a furnace wall between the outer wall and refractory lined inner wall, and additionally includes an annular pattern of angularly related vanes between said inner wall and the inner end of said port arrangement so that incoming combustion air is spiraled as it moves axially along said inlet port toward the combustion zone.

Still another object of the invention is to provide the central tube with steam inlet means adjacent the inlet end of the fuel tube, said inlet means being operable to permit a portion of the inert steam vehicle of the mixture of steam and coal which is concentrated near said central tube as a result of the centrifugal spiraling of the mixture for passage of said portion of steam through said centrifugal tube to the discharge end thereof where the greatest ratio of steam to coal occurs as the same is delivered to said combustion zone, said steam inlet means preferably comprising at least one slot formed longitudinally in said central tube adjacent the inlet end thereof.

One further object of the invention is to provide a method of burning very fine particle sizes of coal of the order of approximately 40 microns and smaller to effect stable ignition, effective control of the flame shape and travel, and effect thorough and complete mixing of the coal and combustion air in a combustion zone which comprises the steps of feeding a stream of a mixture of inert dry steam and said fine sizes of coal under pressure in a spiral manner along a longitudinal path toward a combustion zone to impart centrifugal force to the coal particles and thereby concentrate a substantial portion thereof along the outer portions of said stream so as to separate the same from the steam which concentrates substantially centrally of the stream and feeding combustion air around the exterior of said stream toward said combustion zone and diffuse the stream of coal adjacent the combustion zone to thoroughly mix the same with said combustion air and ignite it at said combustion zone, whereby said initial mixture of steam and coal have a minimum ratio of steam to coal and thereby, prevent any appreciable introduction of steam to said combustion zone.

Details of the foregoing objects and of the invention, as well as other objects thereof, are set forth in the following specification and illustrated in the accompanying drawing comprising a part thereof:

DETAILED DESCRIPTION

As stated above, it is one of the principal objects of the present invention to deliver very finely divided coal particles of not substantially greater size than 40 microns, which is pulverized in a grinding unit, in situ, with the inlet end of a burner tube, and preferably employs dry steam as an inert vehicle or carrier for the pulverized fuel product so as to exclude any premature mixture of the pulverized fuel with combustion air until discharge thereof at the combustion zone, is effected. More importantly, however, the said object is to minimize the ratio of inert carrier or vehicle relative to coal so as to insure effective ignition and not cause any smoothering of the resulting flame by the inert vehicle, and this is accomplished by spiraling the mixture of fuel and inert vehicle within the fuel tube in order that centrifugal force tends to concentrate the finely divided fuel particles, such as coal, close to the inner surface of the fuel tube as it moves longitudinally therealong, while the inert gaseous vehicle is more concentrated along the central portion of the fuel tube and, preferably, adjacent the outer surface of a central tube, which is of substantially smaller diameter than the fuel tube. By this means, the coal is concentrated in the area where ignition occurs adjacent the discharge end of the fuel tube, and in order to effectively promote mixing of the concentrated coal with combustion air, the coal as discharged is diffused in a somewhat conical pattern by means of a vaned diffuser mounted on the discharge end of the fuel tube. Said diffuser is facilitated in its operation by means of a preferably frusto-conical deflector mounted on the discharge end of the central tube and it is still a further objective to mount preferably the inlet end of the central tube in an axially movable adjustable manner with respect to the inlet end of the burner tube so as to vary the relative positions of the diffuser and deflector and thereby, control and vary the shape and travel of the flame.

Figure 1:
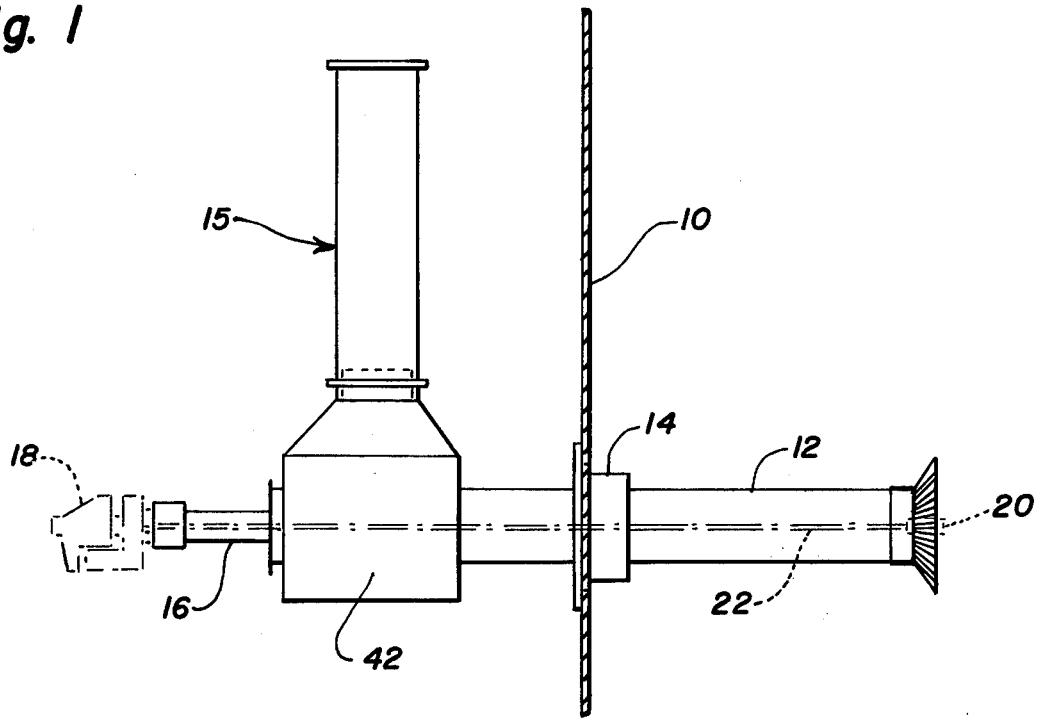
FIG. 1 is a side elevation of the rudiments of the pulverized coal burner embodying the principles of the present invention, said inlet end of the burner tube extending through a suitable coal pulverizer unit in which the coal to be fed to the burner is reduced to desired fine sizes.

Shown in FIG. 1 is a fragmentarily illustrated portion of outer wall 10 of a furnace and through which a burner tube 12 extends by means of a packing gland 14, the portion of the burner tube 12 outside of the furnace wall 10 extends through a suitable conventional coal pulverizing unit 15. Mounted within the burner tube 12 and having a portion thereof projecting beyond the left-hand or inlet end of the burner tube 12, is a central tube 16. Also shown in phantom, at the left-hand end of the central tube 16, is suitable mechanism 18 for controlling the position and operation of an oil or gas fired igniter unit 20, which is shown in phantom at the right-hand end of the burner tube 12 in said figure. The igniter unit is supported on a small elongated tube 22, which extends to the unit 18.

Figure 2:
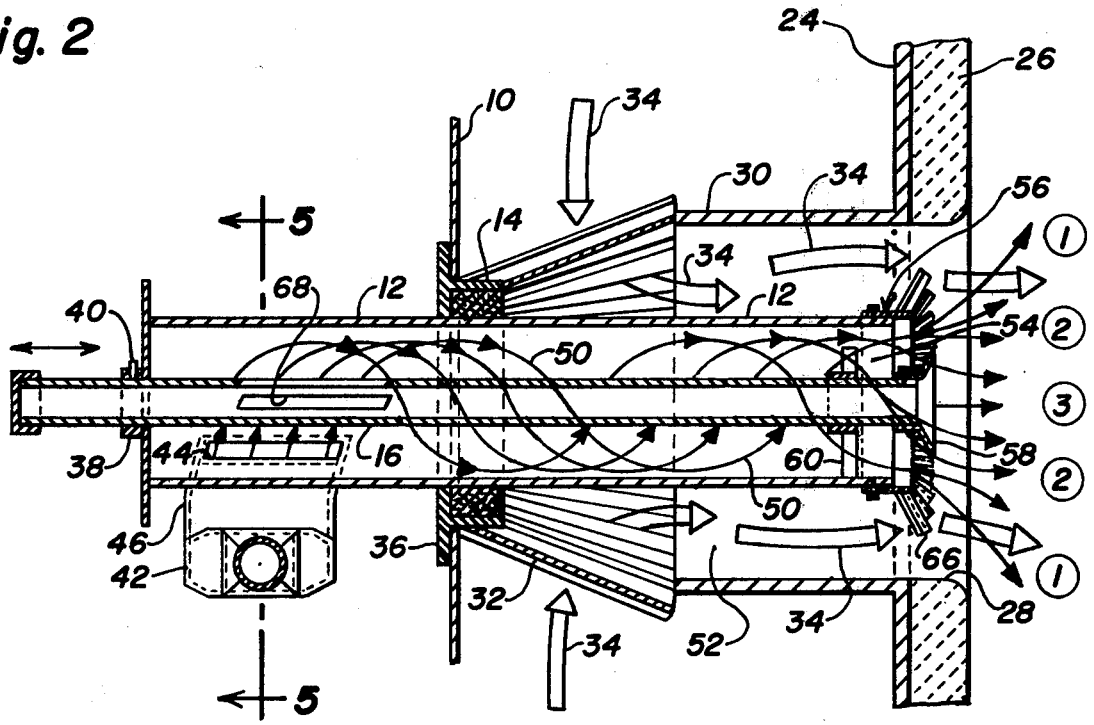
FIG. 2 is a vertical sectional view, illustrated on a larger scale than employed in FIG. 1, and showing in greater particularity the details of the burner in association with an inlet port in a furnace wall through which combustion air is discharged for mixture with the finely divided coal that is discharged from the inner end of the fuel tube, exemplary spiral paths of the fuel within the tube being illustrated by suitable direction lines.

Referring to FIG. 2, a further portion of the furnace wall is illustrated fragmentarily and comprises an inner wall 24, which immediately surrounds the refractory lining 26, said inner wall 24 being provided with a burner opening 28, which is surrounded by a tubular port 30 and is connected to inner wall 24. The inner end of the port 30 is spaced from the outer wall 10 and said space is occupied by a frusto-conical pattern of vanes 32 which extend between the outer wall 10 and the inner end of tubular port 30 in order that combustion air, which is represented by the directional arrows 34, may be introduced in a spiral manner around the outer surface of the burner tube 12.

The burner tube 12 is secured to a flange 36 which is connected to the outer surface of outer wall 10 of the furnace in association with the packing gland 14, whereby the burner tube 12 is preferably stationary with respect to the furnace wall and burner opening 28, while the central tube 16 is longitudinally adjustable and coaxial with the burner tube 12. The left-hand end of central tube 16, as shown in FIG. 2, extends beyond the closed inlet end of burner tube 12, which is at the left-hand end thereof as shown in FIG. 2. The projecting end of the central tube 16 extends through a suitable support 38, such as a collar, having a set screw 40, or any other suitable type of adjustment maintaining means that is actuated after the desired position of the central tube 16 has been established with respect to burner tube 12.

The inlet end of burner tube 12, as indicated above, is surrounded by the lower housing portion 42 of the pulverizing unit 15. Also, as seen from the vertical section shown in FIG. 5, the housing 42 has an inlet opening 44, which communicates with the inlet end of a spiral inlet tube 46 with which the discharge conduit 48 of pulverizing unit 15 directly communicates for the introduction of a mixture of finely divided fuel particles, such as coal of the size ranges referred to above, which has been mixed with an inert gaseous vehicle or carrier, such as dry steam, under pressure, said steam also preferably being used incident to pulverizing the fuel, which is accomplished in the absence of air in order to prevent combustion of the pulverized coal in the pulverizing unit.

Figure 5:
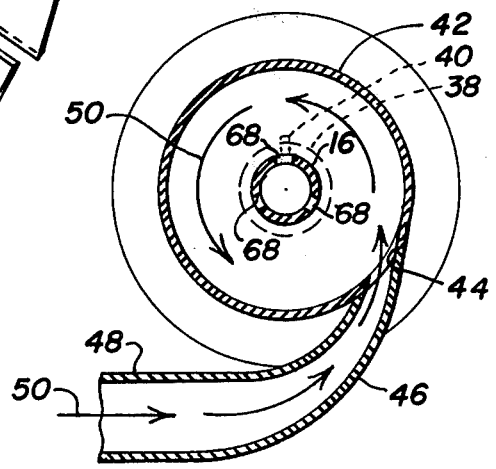
FIG. 5 is a vertical sectional view taken on the line 5—5 of FIG. 2 and showing the tangential spiral inlet means for the mixture of coal and inert vehicle gas for discharge into the inlet end of the fuel tube.

As can be visualized from FIGS. 2 and 5, and especially as illustrated by the spiral directional arrows 50 in FIG. 2, the mixture of finely pulverized coal and inert gas spirals around the central tube 16, as shown by the arrows in FIGS. 2 and 5, and also travels longitudinally within the burner tube 12 toward the discharge end of said burner and central tubes 12 and 16, which is adjacent the right-hand end of FIG. 2 within the burner opening 28 in the inner wall of the furnace. By means of said spiraling action, centrifugal force generated thereby effectively tends to dispose the finely divided coal particles in appreciably concentrated manner adjacent the inner surface of the burner tube 12, thereby causing the inert gas to be concentrated adjacent the outer surface of the central tube 16. This is a highly beneficial operation because, as shown by the directional arrows 34 in FIGS. 2 and 3, the burner tube 12 is surrounded by the combustion air 34 for discharge through the annular passage 52 between the tubular port 30 and burner tube 12, adjacent the burner opening 28, for extensive and complete mixture of the burner air with the concentrated delivery of pulverized coal particles which pass through the annular opening 54 between the discharge ends of the burner tube 12 and central tube 16, said discharge of the coal particles being deflected substantially conically inwardly toward the combustion zone of the furnace. Conical dispersion of the coal particles is effected by the cooperation of the outwardly flared diffuser 56 on the discharge end of burner tube 12 and the preferably frusto-conical deflector 58, which is fixed to the discharge end of central tube 16, as clearly shown in both FIGS. 2 and 3. Incidentally, the discharge end portion of central tube 16 preferably is provided with an additional support 60 within the outer end portion of burner tube 12, as shown best in FIG. 3, and is connected to a supporting sleeve 62, relative to which the central tube 16 is slidable, thereby assuring accurate concentricity of the discharge end of the central tube 16 with respect to the burner tube 12.

The outwardly flared diffuser 15 comprises a collar 64 to which the inner ends of a series of similar vanes 66 are connected, said vanes, and in fact the entire diffuser 56, closely resemble the vanes of a gas turbine. It is clearly obvious from the shape of the vanes 66 that very substantial diffusion of the combustion air 34 is produced by passage between the vanes 66, indicent to intersecting and intimately mixing with the finely divided coal particles, said mixture being very substantially accomplished in the absence of any appreciable amount of the inert gaseous vehicle which initially conveyed and propelled the coal particles from the pulverizing unit 15 to and through the inlet end of the burner tube 12.

Figure 3:
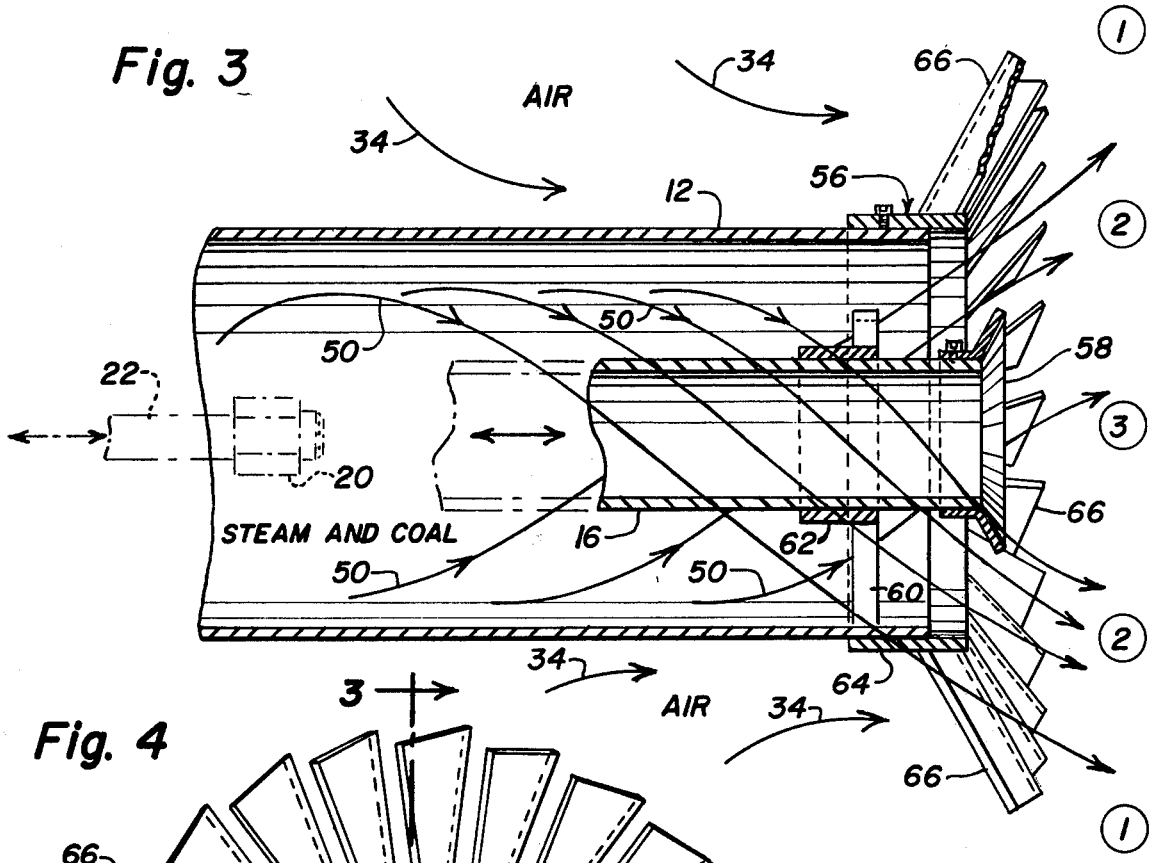
FIG. 3 is a fragmentary view in vertical section similar to FIG. 2, and illustrating the right-hand portion of the burner tube per se, as shown in FIG. 2, and in addition, illustrating in phantom an insertable oil igniter nozzle adapted to be used for initiating combustion when necessary.
Figure 4:
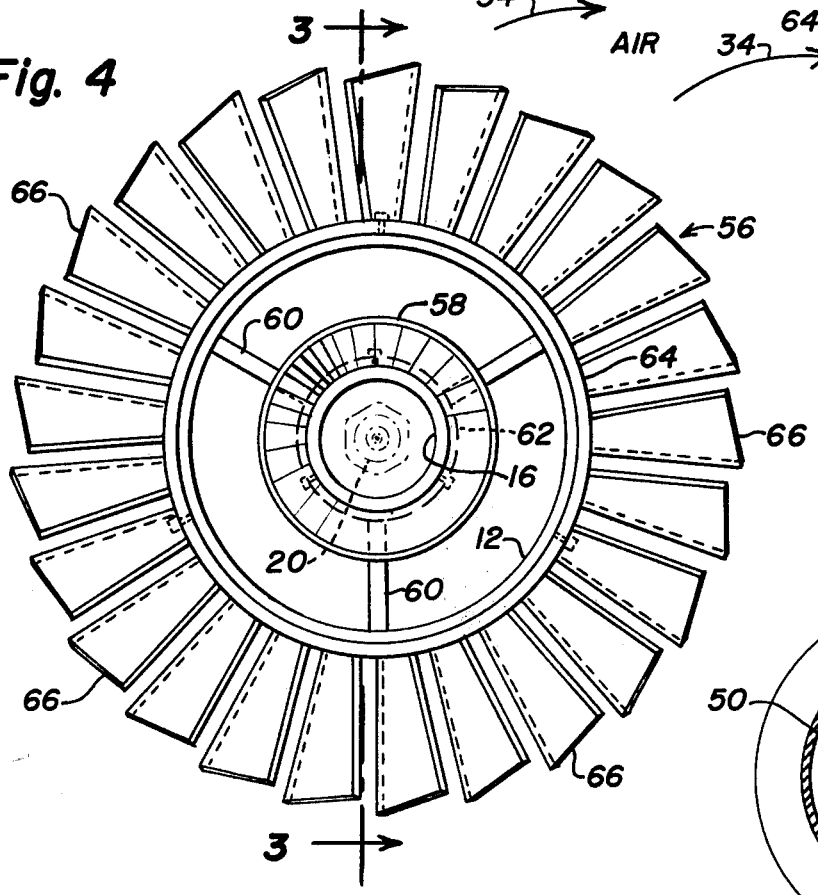
FIG. 4 is an end elevation of the right-hand end of the diffuser mounted on the discharge end of the fuel tube and particularly illustrating details of the vanes comprising the same.

In order that no substantial amount of the inert gaseous vehicle or carrier will be discharged into the most effective area of the combustion which occurs substantially at three zones, ①, ② and ③, as shown in FIGS. 2 and 3, part of the inert gaseous vehicle, at the inlet end of the burner tube 12, is separated from the stream of incoming mixed inert gas and coal particles by means of steam inlet means, preferably comprising a plurality of axially extending slots 68, which are formed in the central tube 16 adjacent the inlet opening 44 in the lower housing portion 42, whereby said separated portion of the gaseous vehicle is forced along the interior of central tube 16 to the discharge end thereof centrally of the deflector 58. As a result of this, it has been found that the proportions of steam to coal are approximately 1.5 pounds of steam per pound of coal in zone ①; 2.5 pounds of steam per pound of coal in zone ②; and approximately 5 pounds of steam per pound of coal in zone ③, but, due to the substantially conical pattern for the discharge of coal from the concentrated region thereof in the outer end of burner tube 12 and the diffusion of combustion air by means of the vanes 66, the major portion of the combustion will occur in zone ①. As a result of this, the greater concentration of the inert vehicle gas in zone ③ has no appreciable affect upon the ignition and efficient combustion which occurs in particular in zone ① and also very satisfactorily in zone ②.

By reason of the longitudinal adjustability of the central tube 16 with respect to burner tube 12, especially the shape and travel of the flame may be varied, due to the adjustable positioning of the deflector 58 with respect to the diffuser 56, and this comprises an important feature of the present invention.

From the foregoing, it will be seen that the present invention provides effective means for initially conveying finely divided coal particles as fuel by entraining the same in as small a proportion of inert gaseous vehicle as possible to prevent combustion of the coal particles until they reach the combustion zone of the furnace, but in conjunction therewith, the invention also provides means for concentrating the coal particles adjacent the inner surface of the burner tube so that the same are in the best position to be intimately and thoroughly mixed with combustion air at the discharge end of the burner tube and thereby, be affected as little as possible by the simultaneous discharge of the inert vehicle gas, which also occurs at the discharge end of the central tube of the burner structure. Thus, the highly essential features of the invention comprise such separation of the coal from the inert gaseous vehicle, coupled with concentrating the coal in the area where ignition primarily occurs in the combustion zone in the furnace. Further, it is necessary to effect initial ignition within the combustion zone, such as at the time of startup of the furnace, an igniter unit 20 may be positioned within the central tube 16 as shown diagrammatically in FIG. 3, and also in FIG. 1, the igniting head 20 being fed by gas or oil and ignited when the head is moved to the region shown in FIG. 1.

The foregoing description illustrated preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A pulverized coal burner for a furnace comprising in combination, an elongated fuel tube, a tangential spiral delivery conduit connected to an inlet opening at one end of said fuel tube and adapted to receive finely divided coal free from air and conveyed by a minimum proportion of inert dry steam to insure delivery of said coal to the opposite end of said fuel tube in the absence of air within said tube, a central elongated tube of smaller diameter mounted coaxially within said fuel tube, means at said one end of said fuel tube supporting a corresponding end of said central tube, the opposite ends of said tubes defining therebetween an annular discharge means for said coal and steam mixture with the absence of air and the tangential delivery thereof to said fuel tube causing said mixture to move spirally and axially along said tube in a manner to cause centrifugal force to effect at least partial separation of the coal from the steam and dispose the coal particles in heavier concentration near the wall of said fuel tube while the steam tends to concentrate near said central tube, a circular outwardly flared diffuser on the discharge end of said fuel tube and an outwardly flared circular deflector on the delivery end of said central tube, an annular air inlet port adapted to be mounted in a furnace wall and coaxially surrounding said fuel tube adjacent the discharge end thereof, and means to deliver combustion air under pressure to said inlet port for mixture with the pulverized coal discharged spirally in an outwardly flared pattern, from said annular discharge means, whereby said coal is at least partially separated from said steam when exiting from said annular discharge means and is delivered to the combustion zone immediately adjacent the delivery of combustion air thereto for maximum burning efficiency with minimum smothering effect by the inert steam due to minimum ratio of inert steam to coal, said central tube is provided with steam inlet means adjacent the inlet end of said fuel tube operable to permit a portion of the inert steam of said mixture of steam and coal which is concentrated near said central tube by the centrifugal spiralling of said mixture for passage of said portion of steam through said central tube to the discharge end thereof where the greatest ratio of steam to coal occures as the same is delivered to said combustion zone.

2. The burner according to claim 1 wherein said outwardly flared diffuser on the discharge end of said fuel tube comprises a series of similar radially extending vanes respectively disposed at an acute angle to a plane transverse to the axis of said fuel tube, thereby diffusing the combustion air as it is introduced to the combustion zone.

3. The burner according to claim 2 wherein said outwardly flared circular deflector on the discharge end of said central tube comprises a frustom of a cone having an outer diameter less than the inner diameter of said fuel tube.

4. The burner according to claim 1 in which said support at said one end of said fuel tube for the corresponding end of said central tube is constructed to permit axial adjustment of one of said tubes relative to the other to vary the axial relation between said diffuser and deflector respectively on the discharge ends of said fuel and central tubes and thereby vary the flame shape and travel.

5. The burner according to claim 4 in which said central tube is supported by said fuel tube for axial adjustment relative thereto and said support means further including means to releasably secure said central tube in a desired adjusted position.

6. The burner according to claim 1 in which said annular combustion air inlet port adapted to be mounted in a furnace wall is adapted to be mounted between the outer wall and refractory-lined inner wall and includes an annular pattern of angularly related vanes to cause the incoming combustion air to spiral as it moves axially along said inlet port.

7. The burner according to claim 1 in which said steam inlet means comprise at least one slot formed longitudinally in said central tube.

* * * * *

UNITED STATES PATENT AND TRADEMARK OFFICE

CERTIFICATE OF CORRECTION

PATENT NO. : 4,147,116

DATED : April 3, 1979

INVENTOR(S) : ROBERT W. GRAYBILL

It is certified that error appears in the above-identified patent and that said Letters Patent are hereby corrected as shown below:

In the caption of the patent, the Assignee thereof should be:

COAL TECH, INC., York, Pennsylvania

Signed and Sealed this

*Seventeenth* Day of *July 1979*

[SEAL]

*Attest:*

LUTRELLE F. PARKER

*Attesting Officer* *Acting Commissioner of Patents and Trademarks*